US007513335B2

(12) United States Patent
Kumar

(10) Patent No.: US 7,513,335 B2
(45) Date of Patent: Apr. 7, 2009

(54) RAILROAD SWITCH LUBRICATOR

(75) Inventor: Sudhir Kumar, Darien, IL (US)

(73) Assignee: Tranergy Corporation, Bensenville, IL (US)

( * ) Notice: Subject to any disclaimer, the term of this patent is extended or adjusted under 35 U.S.C. 154(b) by 0 days.

(21) Appl. No.: 10/447,635

(22) Filed: May 29, 2003

(65) Prior Publication Data

US 2004/0238281 A1 Dec. 2, 2004

(51) Int. Cl.
*B61K 3/00* (2006.01)

(52) U.S. Cl. ..... 184/3.2; 184/3.1; 246/415 R; 246/435 R

(58) Field of Classification Search ..... 184/3.1, 184/3.2; 246/415 R, 435 R
See application file for complete search history.

(56) References Cited

U.S. PATENT DOCUMENTS 1,298,931 A * 4/1919 Gray ..... 246/444
1,546,778 A * 7/1925 De Niff ..... 246/441
3,059,724 A * 10/1962 Soule, Jr. ..... 184/3.1
3,786,618 A * 1/1974 Sommerfeld et al. ..... 96/179
4,125,176 A * 11/1978 Thrasher, Jr. ..... 184/39.1
4,511,016 A * 4/1985 Doell ..... 184/6.11
4,520,901 A * 6/1985 Borup et al. ..... 184/3.1
4,986,498 A * 1/1991 Rotter et al. ..... 246/458
5,192,038 A * 3/1993 Ocampo ..... 246/220
5,236,063 A * 8/1993 Nelson et al. ..... 184/3.2
5,477,941 A * 12/1995 Kumar et al. ..... 184/3.2
5,842,543 A * 12/1998 Naito et al. ..... 184/3.1
6,076,637 A * 6/2000 Kumar ..... 184/3.2
6,446,754 B1 * 9/2002 Kostelny-Vogts et al. .... 184/3.1
6,688,434 B2 * 2/2004 Johnson et al. ..... 184/15.3

FOREIGN PATENT DOCUMENTS

EP 0104050 A1 * 3/1984
EP 104050 A1 * 3/1984
JP 06322701 A * 11/1994
JP 11293602 A * 10/1999
JP 2000008301 A * 1/2000

* cited by examiner

*Primary Examiner*—David M Fenstermacher
(74) *Attorney, Agent, or Firm*—Cook Alex Ltd.

(57) ABSTRACT

This invention is an electro-hydraulic system to automatically lubricate railroad switches and enhance their performance. The lubrication covers switch plates, switch rods, switch points, the base of stock rail adjacent to switch rail and the top of both switch and stock rails. Wear and tear of the switch rail and lateral creep force impact are thus reduced and the switch operates smoothly. Switch related derailments, rail fractures and maintenance labor will be reduced significantly. A pressurized tank with a microprocessor controller, placed on the wayside, supplies an environmentally acceptable smooth-flowing lubricant via hoses or pipes to two nozzle holders with check valves mounted with special brackets a short distance from the switch point on both rails. Lubricant is sprayed with one or more nozzles on each rail switch to cover all or part of the switch length. One or two solenoid valves in the flow lines control the quantity of lubricant applied in each shot and the frequency of application. The solenoid valves are controlled by the programmed microprocessor. An air bubble eliminator trap is placed at a high point in the flow line to remove air trapped in the flow line and enable development of nozzle pressures comparable to the tank pressure. Thus an automatic and efficient new method of enhancing the performance of rail switches is achieved.

32 Claims, 10 Drawing Sheets

RAILROAD SWITCH LUBRICATOR

BACKGROUND OF THE INVENTION

Rail switches are used in turnouts and crossovers to divert trains to other tracks. They are found extensively in railroad and industrial yards. Rail switches are used in conjunction with railway frogs and sometimes with guard rails. All such railroad track components experience serious impact and wear depending on the sharpness of the turns in which they are located. It is therefore necessary to maintain these components regularly. In spite of such maintenance, engineering departments find it necessary to replace switch rails and other moving components much more frequently than other rail. In fact, switches make up a major percentage of engineering department maintenance costs. Switches are also a major factor in derailments. Studies by the Federal Railroad Administration have shown that the majority of derailments take place within 200-300 yards of a switch. As a car enters a switch, a sudden change in direction results in a lateral impact force on the wheels of the car. This force is produced by the lateral creep force on top of the switch rail and the other two rails and contributes to the dynamic instability of the car, which can lead to derailments under certain conditions.

Rolling cars often stall at, or near a switch indicating that considerable car energy is taken away by the switch. This is also due to the lateral creep forces mentioned above. At a recent technical presentation on the New York Transit, the speaker stated that a large percentage of rail fractures occur near switches. It is theorized that these fractures are also related to the lateral creep impact force mentioned above. The current practice of maintaining switches involves using grease or graphite to lubricate the sliding plates and rods of the switch. The switch point and part of the switch gage corner is also sometimes greased. This provides some reduction in wear of the point and the switch rail. It does not, however, reduce the lateral creep force impact on the wheel sets. Moreover, greasing is generally carried out manually once a week or less and often left undone for long periods of time, resulting in excessive wear and tear, rail fractures and occasional derailments. The top of rail near the switch is not greased because of the danger of locomotive wheel slip. In any case the effect of grease only lasts a few hours after application. In other words, there is no consistent protection or performance enhancement currently available for rail switches.

The same is true for rail frogs, which are present at all rail turnouts and crossovers along with switches. Frogs are hit by the lateral creep force impact in the same way that switches are. There has been considerable effort to improve the metallurgy and profiles of the frogs, but to date there is no protection available against the lateral creep impact force. The present invention also provides a solution to the above problem. While the invention presented here is designed for and installed nearer the switch, it also benefits the frog with "carried over" lubricant by reducing the lateral creep force impact on the frog. It provides automatic protection to the switch, thereby reducing manpower demands for its maintenance. It reduces the lateral creep force impact on the switch and thus makes it safer. In other words, it enhances the performance and life of the switch.

SUMMARY OF THE INVENTION

This invention is an electro-hydraulic system that automatically lubricates rail switches and enhances their performance. This lubrication covers switch plates, switch rods, switch points and the base of stock rail at the surface of contact with the switch rail. It provides coverage of these surfaces for all types and lengths of switches. It also provides a very thin coating of lubricant on top of the switch rail and the stock rail so that wheel axles traversing the switch do not experience a large lateral creep force impact. The lubricant is sprayed by one or more nozzles installed in a nozzle holder with a check valve which is mounted with brackets on each rail at a short distance from the switch point with nozzle sprays aimed at the switch. The type of switch and the traffic it experiences determines the quantity and frequency of lubricant sprayed. The quantity is controlled by one or two solenoid valves (with or without check valves) that are controlled by a microprocessor. The lubricant shot may be fired at any desired frequency, from several times a day to a few times per week or month. For increased protection, it may be fired every time a train approaches the turnout of the switch. The lubricant fluid is supplied by a wayside tank under pressure connected to the nozzle brackets with hoses or pipes. In order to keep flow rates consistent, the invention includes an air bubble trap in the lubricant hose that enables the removal of air from the lubricant flow line. AC power, solar cells with a battery or just a battery that lasts longer than the pressurized tank can power the microprocessor and the solenoids. Thus an automatic and efficient new method of enhancing the performance of rail switches is achieved.

DETAILED DESCRIPTION ON THE INVENTION

Figure 1:
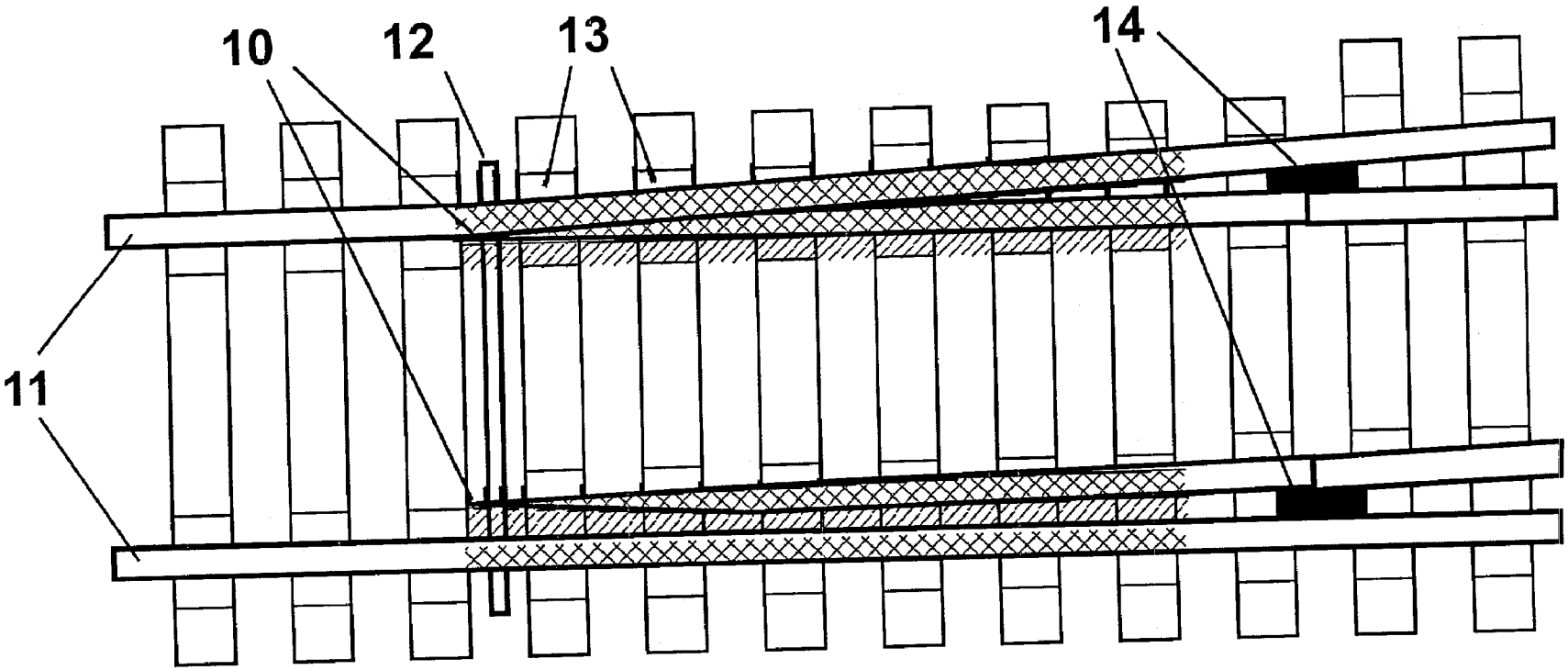
FIG. 1 is a schematic plan view of a switch including switch plates and rails, with shaded areas indicating where lubrication is needed

The present invention is designed to provide effective automatic lubrication to railroad switches. It is mounted adjacent to a switch. At present, the industry practice is to lubricate the switch plates and the points manually at a certain frequency (once a week or month or longer). This is manpower intensive and leads to irregular maintenance of the switch especially in remote areas. Switches are operated either manually or by a powered switch machine. Without effective lubrication, the operation can be demanding on the power machine or the person throwing the switch and even then, the switch may not engage fully. Thus an injury hazard is present for the person throwing the switch. While the manual pouring of lubricant on switch plates does permit the switch to open or close easily it does not provide protection to the switch points, which become worn and torn at the tip very quickly compared to other rail. In fact, switch points are replaced every few years making them a significant part of track maintenance costs.

Railroad derailment data indicates that a majority of main line derailments take place within 200-300 yards of a switch. It is also understood from speaking with a major transit system official that a majority of rail fractures also occur near switches. When a wheel axle hits a switch, it experiences a sudden lateral change of direction. Not only is the derivative of the lateral displacement with respect to time large, but the wheel set also experiences a large second derivative. These displacements are associated with large lateral impact like forces experienced under normal conditions when the top of switch rails and the adjacent stock rail have friction coefficients between 0.3 and 0.5. To withstand these large lateral impact forces, the rail is often braced laterally by bracing devices mounted on the stock rail and the switch rail is reinforced on the web. If this top of rail friction coefficient is reduced significantly by effective lubrication with a suitable lubricant, the lateral force stresses produced on the stock rail and the switch point rail can be proportionately reduced.

At present it is not possible to accomplish such lubrication because grease cannot be applied on top of the rail for fear of wheel slip. Even if grease were applied its benefit would last only a few hours. Manual lubrication does not permit consistent lubrication. The result of this is severe wear of the switch point, switch rail and eventual rail fracture. Occasionally, train dynamics become unstable resulting in derailments. In harsh winter climates, switch plates freeze requiring manual heating or heating with installed electric switch heaters. Many of the above problems can be solved or reduced significantly by the present invention of lubricating rail switches automatically with a suitable non-freezing lubricant. The lubricant needs to be a smooth, well-flowing uniform lubricant, such as some of the synthetic, polymer-based lubricants that are environmentally clean, and have a wide operating temperature range (−20° to 160° F. or even wider). It should also prevent freezing of switch plates. Its viscosity should be such that a very fine spray is developed by nozzles under pressure, thus allowing formation of a very thin film of lubricant on the rail and switch components. This would also avoid locomotive wheel slip problems—frequent application of this film enables reduction of lateral creep forces for the train without developing other adhesion problems.

The general arrangement of a rail switch of the type used extensively in North America is shown in FIG. 1. The stock rails 11 in conjunction with two switch rails 10 implement the switching of two rails from one track to another. The opening and closing of the switch is accomplished by a number of switch rods 12 (only one set is shown in FIG. 1) which may be powered by a switch machine (not shown) or operated manually. The tie plates used in the switch are essentially double plates, one set for the stock rails and the other for switch rails. The switch rails, sometimes also known as switch points, slide on a switch plate mounted on the tie plate 13 of the stock rails to conduct the switching process. The switch rails swing around the switch heels 14. This diagram also shows two single hatched areas which cover part of the switch plates. The current practice of lubrication essentially covers just this area. What is required is an additional degree of lubrication on top of both the stock rails and the switch rails, which is represented in FIG. 1 as double cross hatched surfaces.

Figure 2:
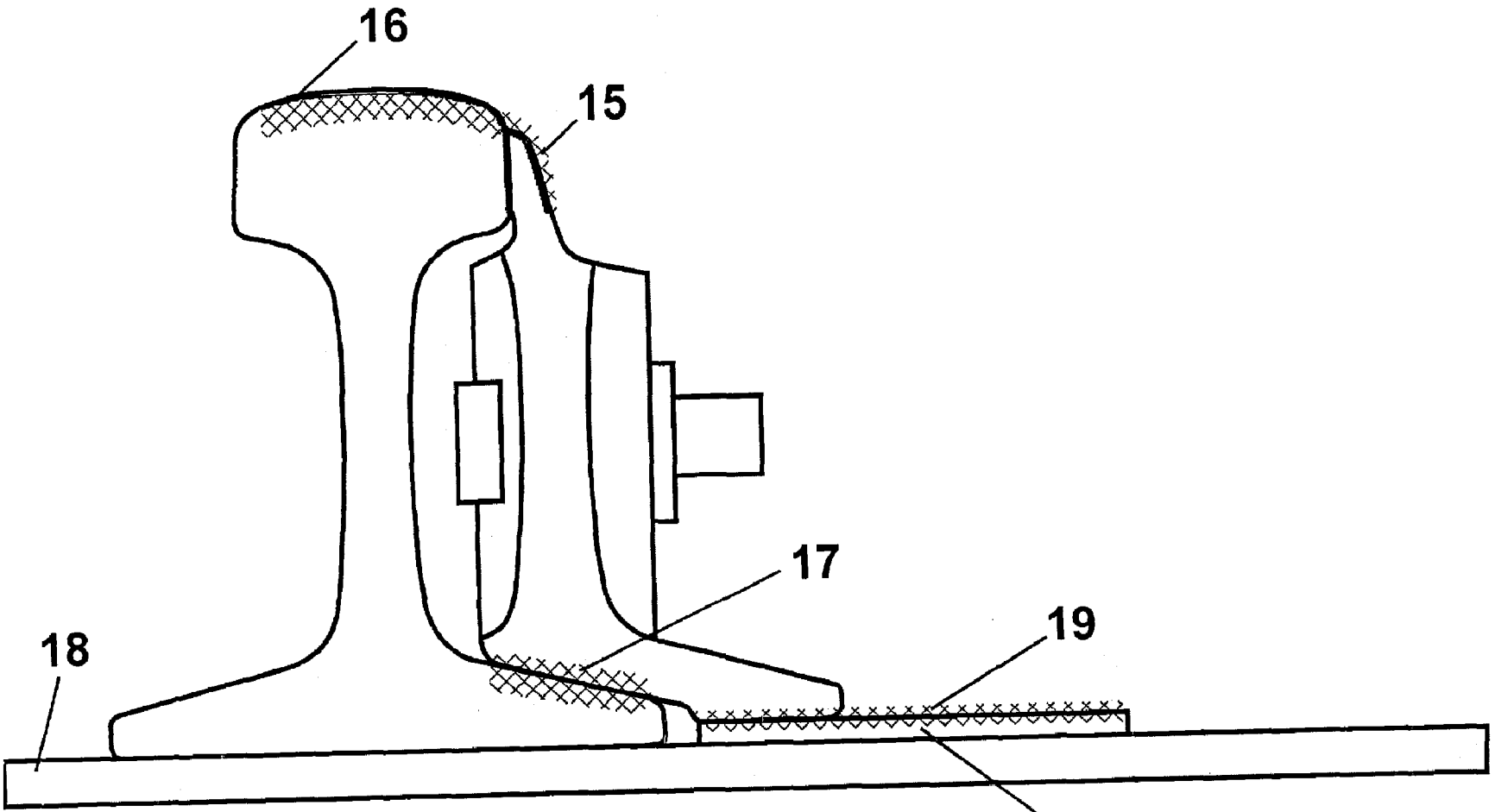
FIG. 2 is a front elevation view of a switch point, tie plate and switch plate, with the shading indicating where lubrication is needed.

FIG. 2 shows a cross sectional frontal view of the stock rail 16 and the switch rail 15. The stock rail is mounted on a tie plate 18. The switch rail 15 is supported on its own switch plate 7. The current practice of lubrication provides occasional, manually-applied lubricant coverage on the upper surface 17 the stock rail base and the upper surface 19 of plate 7. What is required, and what the present invention for the first time provides, is to lubricate the upper surfaces of the rails 15 and 16, as well as the surfaces 17, 19 at a higher frequency with a thin film of lubricant. This lubrication is indicated in FIG. 2 by the double cross hatched areas.

Figure 3:
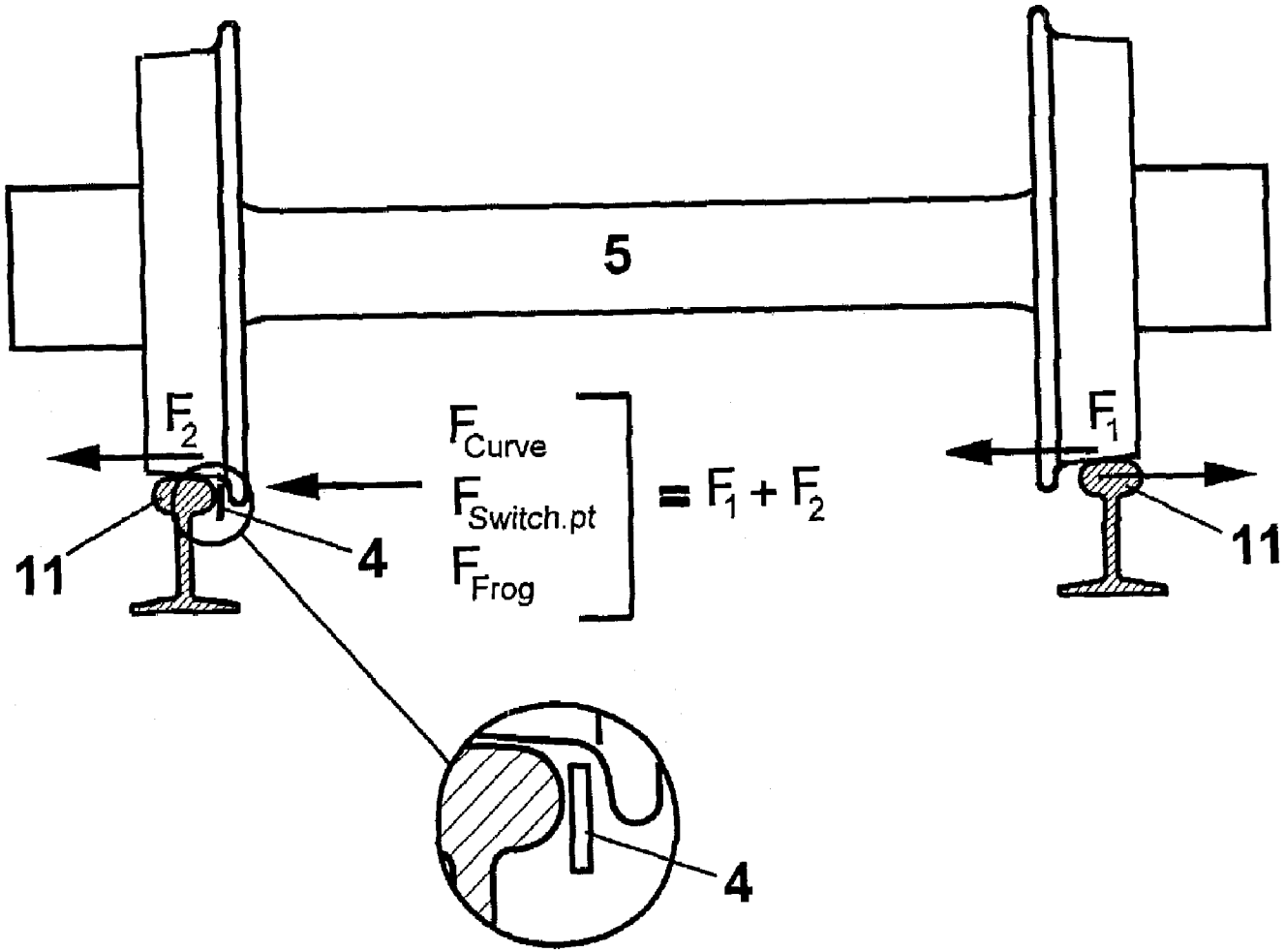
FIG. 3 is a diagrammatic cross section of a track showing a wheel set approaching a switch point, curve or frog with lateral friction forces, and with a detail of a wheel flange, switch point and rail flange shown in an enlarged inset.
Figure 4:
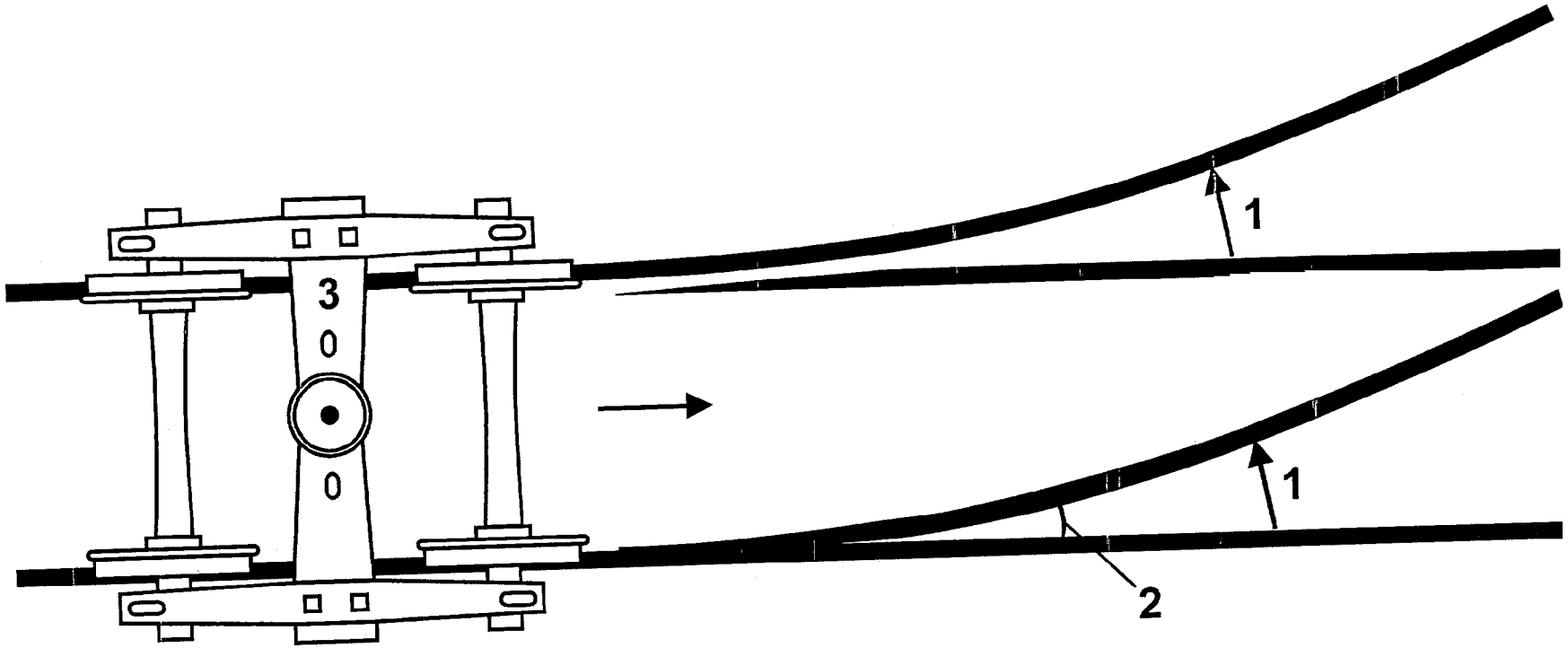
FIG. 4 is a plan view showing a truck approaching a turnout, resulting in an angle of attack and lateral slip of the wheels.

FIGS. 3 and 4 explain briefly the lateral creep forces produced on an axle 5 of a car truck 3 when it goes over a switch rail or point 4, frog or curve. As the axle approaches a switch point (FIG. 3), there is a sudden lateral displacement of the axle due to the thickness of the point or the frog. This displacement produces lateral friction forces $F_1$ and $F_2$ on the axle. Under normal dry conditions, when the friction coefficient on top of the rail is high (~0.5), this force produces a lateral impact pulse. If the top of the rail and the point are lubricated, this impact force magnitude can be significantly reduced by 50 to 90 percent, making the turnout smooth. After the axle has entered the switch, there is still a large lateral creep force developed due to lateral slip of the wheel on the rail (FIG. 4). An angle of attack 2 is present as the axle moves through the turnout. The wheel slips laterally by the magnitude of the arrows 1. The greater the sharpness of the curve, the larger the angle of attack 2 and the corresponding slip 1. This lateral creep or slip produces very large (~20,000 lb) forces for dry rail of sharp curves. When lubricated on top of the rail, this force can be reduced to 5000 lb or less.

Figure 5:
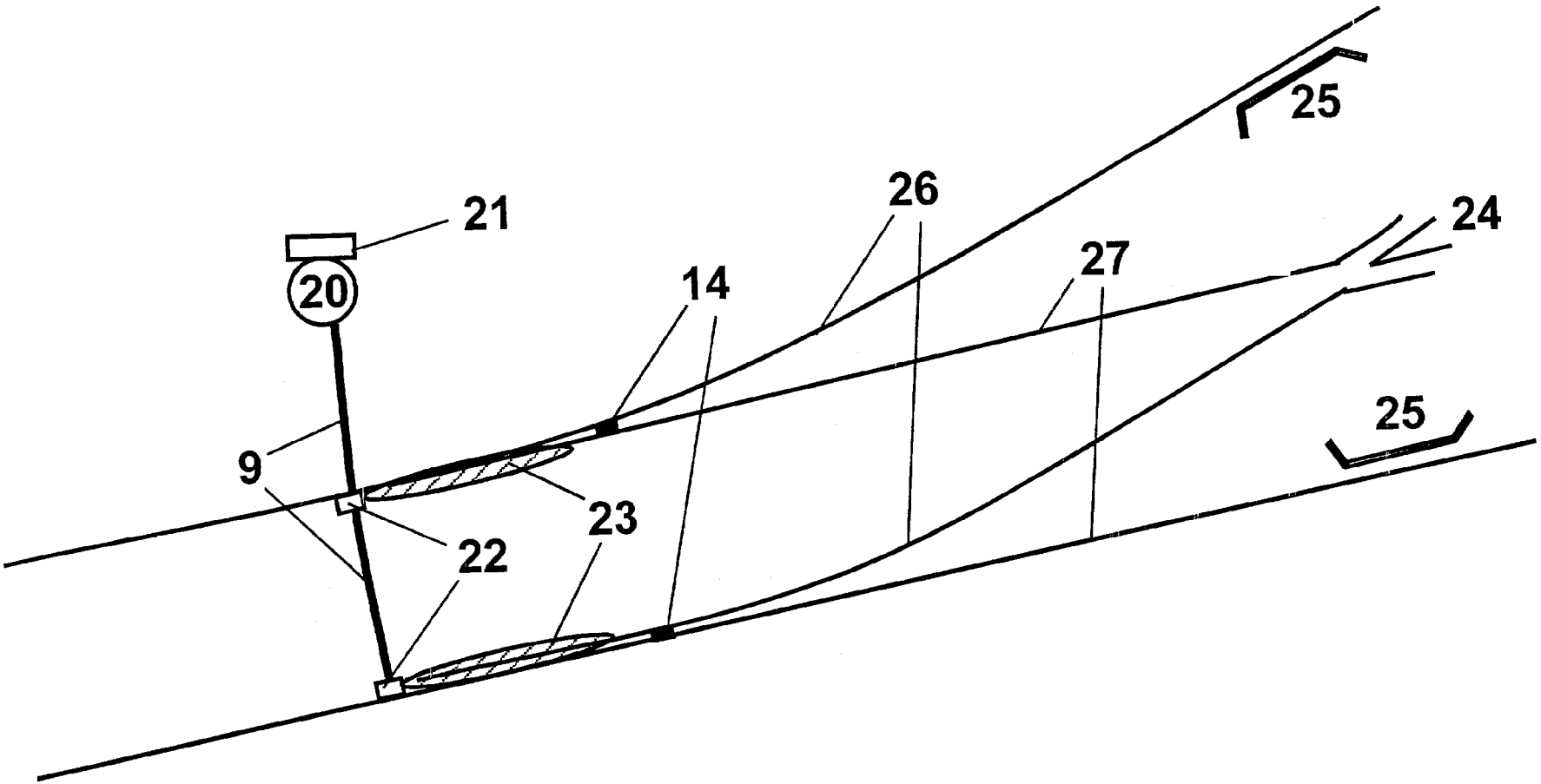
FIG. 5 is a schematic plan view of a switch enhancer installed on a switch, with a frog and optional guard rails also shown.

FIG. 5 shows a schematic arrangement of the rail switch enhancer of the present invention placed on a switch of a rail turnout. The straight rail 27 and turnout rails 26 along with frog 24 and guard rails 25 are shown in the diagram. The switch rails pivot on the switch heels 14. The switch enhancer components include a set of spray nozzles and check valves in a nozzle holder mounted on brackets attached to each rail 22. These nozzles are supplied with lubricant under pressure via hoses or pipe 9 from a pressurized tank 20 containing the lubricant. The controller located in a box 21 is mounted on or near the tank. The tank 20 and box 21 may be enclosed in another box for security. The nozzle spray 23 occurs at a specified frequency with a specified amount of lubricant to cover the switch, the plates, the switch rods, the base of the stock rails, and the top of the switch and stock rails, providing protection and enhancing switch performance. On main line switches with heavy traffic, it may be desirable to apply a lubricant shot prior to every train going through the turnout. This can be triggered by a signal from the switch controller to open the switch for the turnout. The lubricant sprayed on top of the stock and switch rails is carried forward by the train wheels and lubricates the top of all four rails reducing the lateral creep impact forces, and thus protecting, the frog 24 and the guard rails 25.

Figure 6:
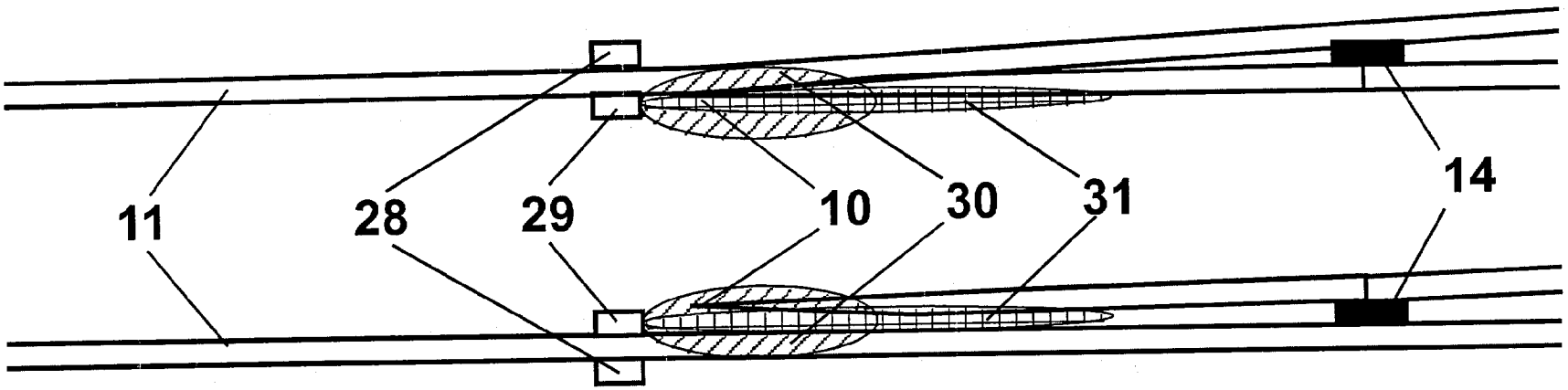
FIG. 6 shows a plan view of how one or more nozzle sprays can cover the switch and the stock rail.

FIG. 6 shows another view and arrangement of lubricant sprays 30 and 31. In order to increase the coverage area laterally a nozzle with a wider spray 30 may be used. In addition, another nozzle with a long range of spray application 31 is used. This nozzle spray can reach up to the heel 14 if so desired. One or more nozzles may be used for each rail. These are mounted on the stock rail 11 with brackets 28 and spray nozzle holders 29 mounted at a distance in front of the switch point 10. This distance can vary from zero to several feet depending on the type of nozzles used. It is preferable to place the nozzles near the switch opening. However, it is also possible to mount the nozzles on the rail beyond the heel and fire the lubricant shot towards the switch point. This arrangement will also provide some enhancement of the switch.

Figure 7:
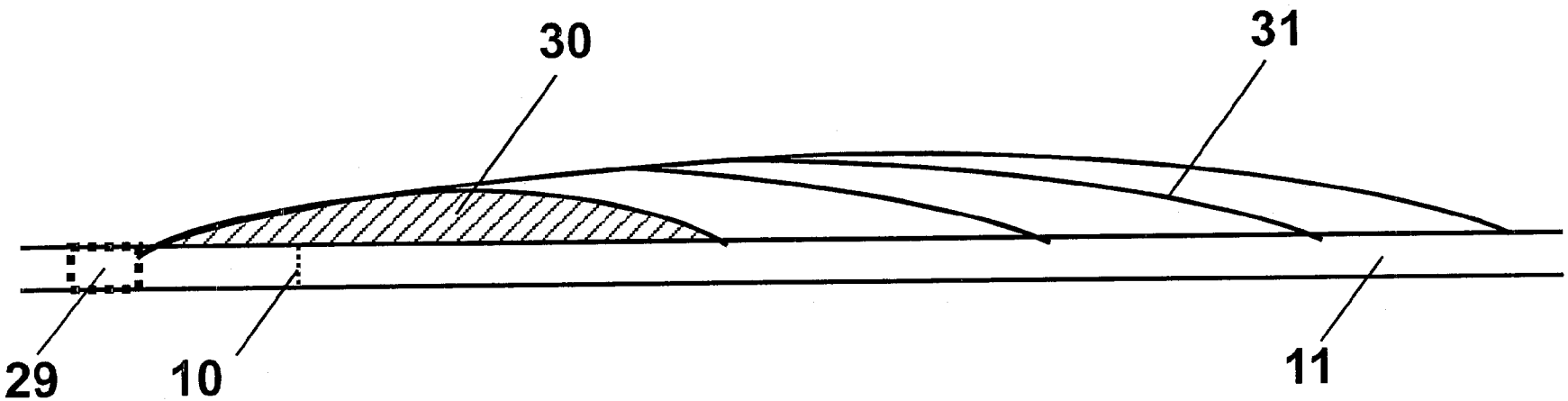
FIG. 7 is a side elevation view of the lubricant spray shots covering a long switch/rail area.

FIG. 7 shows a side view of the spray of the nozzles installed on the rails 11 with rail brackets and nozzle holders 29. The wide spray coverage nozzles spray up to a shorter distance with spray 30. The long range spray travels deep into the switch at farther distances 31. This arrangement can be varied depending on the types of nozzles used.

Figure 8A:
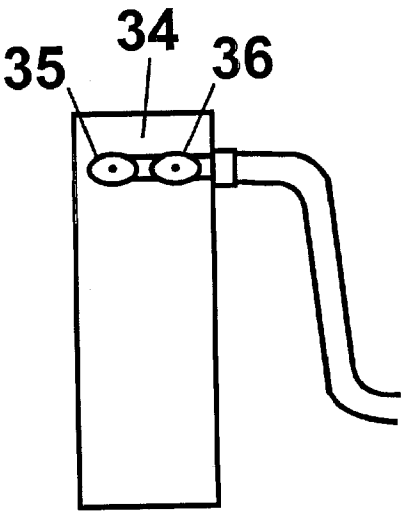
FIG. 8A is a side elevation view of an alternate embodiment of the nozzle block holder.
Figure 8:
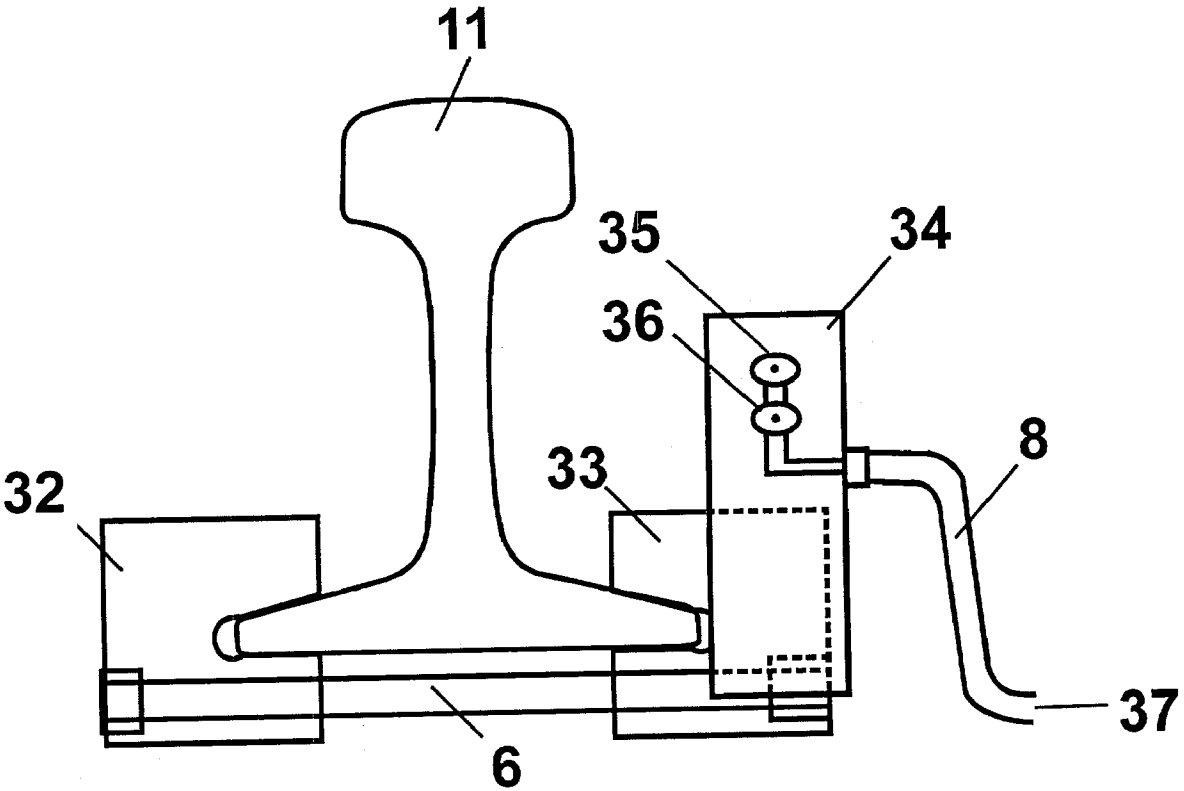
FIG. 8 is a schematic cross section of a rail, showing the mounting brackets for the spray nozzle holder.

FIG. 8 shows special bracket clamps 32, 33 holding the base of the rail with bolts 6 below the base of the rail. On the gage side bracket 33, a nozzle holder block 34 is mounted to install the nozzles 35 and 36. The height of the nozzles above the base of the rail can be adjusted but the block should be an inch or more below the rail head so that wheel flanges or any dragging equipment does not hit the nozzle holder block. The arrangement of nozzles (if more than one) 35 and 36 can vary on the nozzle holders 34. Two such positions are shown in FIG. 8 and FIG. 8A. A solenoid-controlled valve may be used in the nozzle holder 34 to apply a short duration spray. In its absence, a check valve can also be used to reduce spray jet dripping from nozzles 35 and 36. In order to reduce nozzle clogging, a filter is also used in fluid line 8. The lubricant enters fluid line 8 at a pressure 37 suitable for the range of spray needed.

Figure 9:
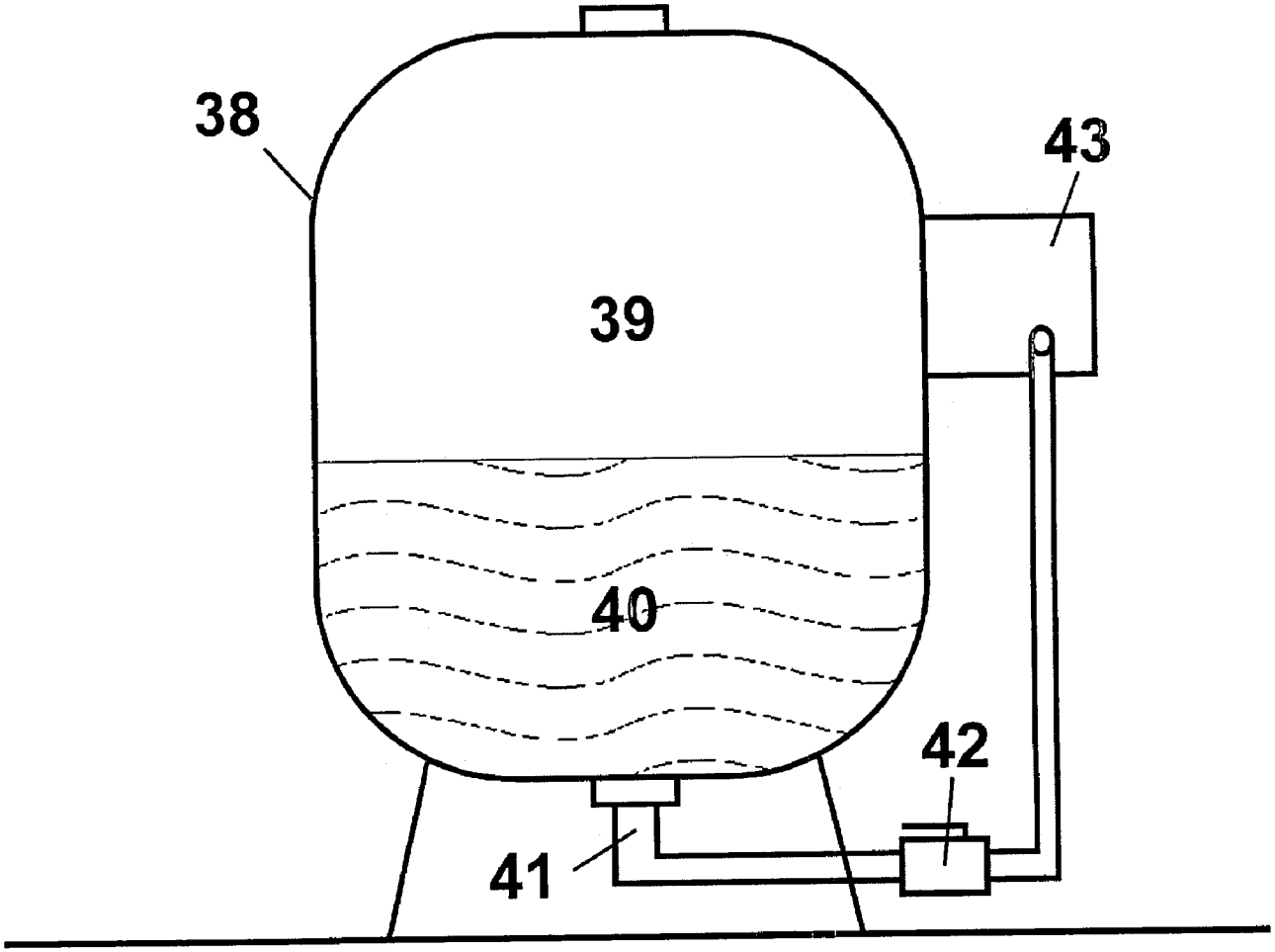
FIG. 9 is a schematic side elevation view of the pressurized lubricant tank with the controller box mounted on it.

FIG. 9 shows the pressurized tank 38 with lubricant 40 and compressed gas 39. The tank is connected via piping or hose 41 to the controller box 43 with a suitable in-line shut off valve 42.

Figure 10:
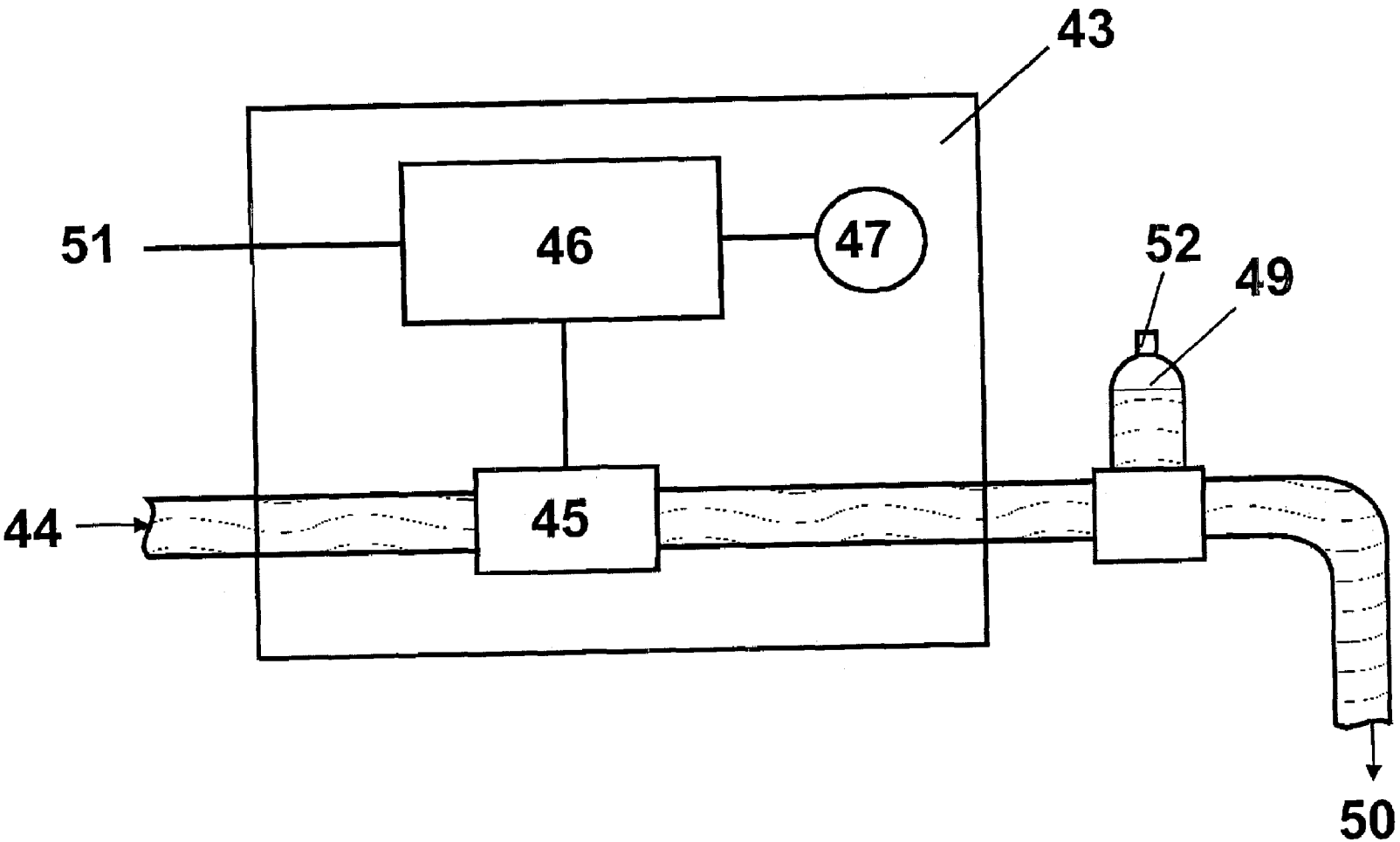
FIG. 10 shows the controller box with microprocessor, buzzer, solenoid valve and air bubble eliminator trap.

FIG. 10 shows the controller housed in box 43 along with an air bubble eliminator trap 49. Lubricant under pressure from the tank enters line 44 in the direction shown. An inline solenoid valve 45 is located in the controller box. The duration for which the solenoid valve is open and the frequency at which the nozzles spray the lubricant is controlled by a microprocessor 46 powered by AC power, a DC battery or a solar cell through power line 51. The microprocessor also controls a buzzer 47 that emits an audible alarm prior to application of the lubricant. This alarm alerts any personnel working nearby to leave the vicinity of the switch to avoid the lubricant spray. An important part of this invention is the use of an air bubble eliminator trap 49. In such a hydraulic system, a large air bubble invariably develops during setup and becomes compressed at the time of the spray. This causes the pressure at the nozzle to be significantly lower than the pressure in the tank, causing the amount and distance of fluid application to be lower than the desired value. In the presence of such an air bubble, flow through the nozzle does not shut off immediately after the solenoid valve turns off—instead it slows over time to a drip. To remove this air bubble, an air trap with a release valve 52 is installed at a high point in the fluid line. Once the air bubble rises to the trap, opening the valve slightly releases the air followed by a small amount of fluid. Once this "bleeding" process is completed, the pressure experienced at the nozzle is significantly increased and the lubricant shot becomes more consistent.

In this way the rail switch enhancer continues to make an automatic lubricant application to switch components and the top of rail for many months at a defined moment and quantity. The regularity of a small lubricant application reduces switch wear and improves train rolling on the switch thereby enhancing switch operation.

While a preferred embodiment of the invention has been shown and described, it will be realized that alterations may be made thereto without departing from the scope of the following claims. For example, instead of the lubricant reservoir having a pressurizing gas therein, a pump could be used to supply lubricant under pressure to the nozzles.

I claim:

1. In a railroad switch comprising first and second stock rails fixedly mounted on tie plates, a first switch rail pivotably connected at one end to a heel and mounted laterally adjacent to a mating portion of the first stock rail for sliding movement on a plurality of switch plates into and out of closing relation with the first stock rail, a second switch rail pivotably connected at one end to a heel and mounted laterally adjacent to a mating portion of the second stock rail for sliding movement on a plurality of switch plates into and out of closing relation with the second stock rail, at least one switch rod connected to the first and second switch rails, the stock rails and switch rails each having a base and a head with the head defining a top of the rail, the improvement comprising a switch lubricator including a lubricant reservoir, a fluid supply line connected to the lubricant reservoir, a valve in the fluid supply line, a controller for opening and closing the valve to control flow through the fluid supply line, a first main nozzle connected to the fluid supply line and mounted on one of the stock rails, the first main nozzle having an aperture which is sized and aimed to produce a spray pattern of lubricant wherein at least a first portion of the projected lubricant alights on the top of the mating portion of said one stock rail and at least a second portion of the projected lubricant alights on the top of the switch rail most closely adjacent to said one stock rail.

2. The switch lubricator of claim 1 further comprising a second main nozzle connected to the fluid supply line and mounted on the other of the stock rails, the second main nozzle having an aperture which is sized and aimed to produce a spray pattern of lubricant wherein at least a first portion of the projected lubricant alights on the top of the mating portion of said other stock rail and at least a second portion of the projected lubricant alights on the top of the switch rail most closely adjacent to said other stock rail.

3. The switch lubricator of claim 2 further characterized in that the spray patterns of the first and second main nozzles are further defined in that at least a third portion of the lubricant projected from each nozzle alights on the switch rod.

4. The switch lubricator of claim 3 further characterized in that the spray patterns of the first and second main nozzles are further defined in that at least a fourth portion of the lubricant projected from each nozzle alights on at least a portion of the bases of said one and the other stock rails, respectively and on at least a portion of the bases of said switch rails, respectively.

5. The switch lubricator of claim 1 further comprising a first wide-range nozzle connected to the fluid supply line and mounted on said one of the stock rails, the first wide-range nozzle having an aperture which is sized and aimed to produce a spray pattern of lubricant that is wider and shorter than that of said first main nozzle.

6. The switch lubricator of claim 2 further comprising a first wide-range nozzle connected to the fluid supply line and mounted on said one of the stock rails, the first wide-range nozzle having an aperture which is sized and aimed to produce a spray pattern of lubricant that is wider and shorter than that of said first main nozzle.

7. The switch lubricator of claim 1 further comprising pressurizing means for supplying lubricant under pressure to the nozzle.

8. The switch lubricator of claim 7 wherein the pressurizing means controls the length of the spray pattern.

9. The switch lubricator of claim 8 further comprising a check valve in the fluid supply line between the valve and the nozzle to reduce nozzle drip after the spray.

10. The switch lubricator of claim 1 wherein the controller comprises a microprocessor.

11. The switch lubricator of claim 1 further comprising a bracket mounted on the base of said one stock rail, the nozzle being mounted on the bracket.

12. The switch lubricator of claim 1 further comprising an air bubble eliminator trap in the fluid supply line.

13. The switch lubricator of claim 12 wherein the air bubble eliminator trap includes a valve to remove air that is trapped in the fluid supply line.

14. The switch lubricator of claim 1 further comprising a buzzer which sounds an alarm before the lubricant shot is made so that personnel working nearby are alerted to move away from the switch.

15. In a railroad switch comprising a plurality of stock rails fixedly mounted on tie plates and a pair of switch rails pivotably connected to heels and mounted for sliding movement on switch plates between straight through and turnout positions, the stock rails and switch rails each having a base and a head, the head defining a top of the rail, the improvement comprising a method of reducing lateral forces on the stock rails and switch rails including the steps of mounting at least one spray nozzle in a fixed location with respect to the switch rails and applying a lubricant in a spray pattern that will result in the lubricant from said spray nozzle alighting on at least a portion of the top of one of the switch rails and on the top of one of the stock rails.

16. The method of claim 15 wherein the quantity of lubricant sprayed is controlled by changing the duration for which a valve in a fluid supply line is open.

17. The method of claim 15 wherein the step of applying a lubricant is further characterized by arranging the spray pattern such that lubricant from said spray nozzle alights on at least a portion of the switch plates.

18. The method of claim 15 further comprising the step of mounting at least one spray nozzle on each of two separate stock rails and aiming the nozzles such that each of the heads of the switch rails and stock rails have lubricant applied to their tops.

19. The method of claim 15 further characterized in that the applying step is triggered by a signal moving the switch rails to the turnout position so that a lube shot is made prior to the arrival of every train into the turnout.

20. The method of claim 15 further characterized in that the applying step is triggered by a timer programmed at defined intervals of time.

21. The switch lubricator of claim 5 further comprising a second wide-range nozzle connected to the fluid supply line and mounted on the other of the stock rails, the second wide-range nozzle having an aperture which is sized and aimed to produce a spray pattern of lubricant that is wider and shorter than that of said first main nozzle.

22. The switch lubricator of claim 6 further comprising a second wide-range nozzle connected to the fluid supply line and mounted on the other of the stock rails, the second wide-range nozzle having an aperture which is sized and aimed to produce a spray pattern of lubricant that is wider and shorter than that of said second main nozzle.

23. A switch lubricator for lubricating a switch having a plurality of stock rails and a pair of switch rails, each switch rail being associated with a mating portion of one of the stock rails, each of said stock rails having a base, said switch lubricator comprising: a nozzle positioned at a fixed location with respect to at least one of the stock rails, said nozzle aimed to produce a spray pattern of lubricant wherein at least a portion of the lubricant projects from the nozzle directly onto the tops of at least one switch rail and the mating portion of its associated stock rail.

24. The switch lubricator of claim 23 in which each base of the stock rails has an upper surface and the nozzle is aimed to produce a spray pattern of lubricant wherein at least a portion of the lubricant projects from the nozzle directly onto at least a portion of the upper surface of the base of one of the stock rails.

25. The switch lubricator of claim 23 wherein the switch rails are supported on switch plates and in which the nozzle is aimed to produce a spray pattern of lubricant wherein at least a portion of the lubricant projects from the nozzle directly onto at least a portion of an upper surface of a switch plate of one of the switch rails.

26. The switch lubricator of claim 23 in which the nozzle is aimed to produce a spray pattern of lubricant wherein at least a portion of the lubricant projects from the nozzle directly onto at least a portion of the surface of the base of at least one of the stock rails that engages a switch rail.

27. The switch lubricator of claim 23 in which the nozzle is mounted on one of the stock rails.

28. The switch lubricator of claim 23 in which each of the switch rails has a gage surface and the nozzle is aimed to produce a spray pattern of lubricant wherein at least a portion of the lubricant projects from the nozzle directly onto at least a portion of the gage surface of one of the switch rails.

29. The switch lubricator of claim 23 in which each of the stock rails has a gage surface and the nozzle is aimed to produce a spray pattern of lubricant wherein at least a portion of the lubricant projects from the nozzle directly onto at least a portion of the gage surface of one of the stock rails.

30. The switch lubricator of claim 23 in which each of the switch rails is engageable with a stock rail at a mating surface and the nozzle is aimed to produce a spray pattern of lubricant wherein at least a portion of the lubricant projects from the nozzle directly onto at least a portion of said mating surface.

31. The switch lubricator of claim 23 in which the switch rails are joined by at least one switch rod and the nozzle is aimed to produce a spray pattern of lubricant wherein at least a portion of the lubricant projects from the nozzle directly onto at least a portion of the switch rod.

32. The switch lubricator of claim 23 in which each of the switch rails has a switch point at its free end and the nozzle is aimed to produce a spray pattern of lubricant wherein at least a portion of the lubricant projects from the nozzle directly onto at least one switch point.

* * * * *